US008028936B2

(12) United States Patent
McDermott

(10) Patent No.: US 8,028,936 B2
(45) Date of Patent: Oct. 4, 2011

(54) SPRAY NOZZLE

(76) Inventor: Peter McDermott, Old Alresford (GB)

( * ) Notice: Subject to any disclaimer, the term of this patent is extended or adjusted under 35 U.S.C. 154(b) by 39 days.

(21) Appl. No.: 12/372,327

(22) Filed: Feb. 17, 2009

(65) Prior Publication Data

US 2010/0206966 A1 Aug. 19, 2010

(51) Int. Cl.
*B05B 1/34* (2006.01)

(52) U.S. Cl. ..... 239/463; 239/468; 239/487; 239/491; 239/590.5

(58) Field of Classification Search ..... 239/463, 239/468, 469, 476, 486–488, 490–492, 536, 239/548, 590.5
See application file for complete search history.

(56) References Cited

U.S. PATENT DOCUMENTS 1,665,744 A * 4/1928 Landberg ..... 239/548
2,358,177 A * 9/1944 Madison ..... 239/469
2,458,876 A * 1/1949 Rehn ..... 239/487
2,984,421 A * 5/1961 Hession, Jr. ..... 239/488
3,762,652 A * 10/1973 Huling ..... 239/469
7,611,080 B2 * 11/2009 Peterson et al. ..... 239/463

* cited by examiner

*Primary Examiner* — Steven J Ganey
(74) *Attorney, Agent, or Firm* — Ladas & Parry LLP

(57) ABSTRACT

A spray nozzle, particularly well adapted for use in compressor spray cleaning systems, has a nozzle body with a right angle fluid delivery bore having a first passageway section extending longitudinally and at least one connected transverse nozzle bore section terminating in a reduced diameter spray bore at a sidewall of the nozzle body. A swirler is mounted in the nozzle bore section, and has a head section with a plurality of passageways formed between swirl vanes arranged about a periphery of the head section to pass fluid to the spray bore and an adjacent neck section of a reduced diameter. The neck forms an annulus between the neck and the nozzle body in fluid-passing contact with the first passageway section and head section to direct fluid from the first passageway through the head passageway for exit through the spray bore. The nozzle can be used in spray systems over a wide range of fluid delivery volumes and pressures.

11 Claims, 10 Drawing Sheets

FIG. 8

| Nozzle dia/slot no. | 0.50mm 4 slot | | 0.75mm 4 slot | | 0.90mm 4 slot | | 1.50mm 7 slot | | 2.00mm 7 slot | | 3.50mm 7 slot | |
|---|---|---|---|---|---|---|---|---|---|---|---|---|
| Pressure | Flow (lpm) | Droplet size Dv90 micron | Flow (lpm) | Droplet size Dv90 micron | Flow (lpm) | Droplet size Dv90 micron | Flow (lpm) | Droplet size Dv90 micron | Flow (lpm) | Droplet size Dv90 micron | Flow (lpm) | Droplet size Dv90 micron |
| 7 | 0.53 | | 0.6 | | 0.98 | | 2.22 | | 3.4 | | 5.4 | |
| 10 | 0.68 | 148 | 0.65 | 167 | 1.01 | 306 | 2.6 | 253 | 3.95 | 242 | 6.4 | |
| 20 | 0.83 | 129 | 0.9 | 141 | 1.4 | 180 | 3.6 | 192 | 5.4 | 203 | 8.6 | 621 |
| 30 | 0.96 | 122 | 1.12 | 132 | 1.8 | 157 | 4.32 | 143 | 6.85 | 176 | 10.4 | 500 |
| 40 | 1.07 | 118 | 1.3 | 124 | 2.01 | 137 | 5.1 | 119 | 8.1 | | 12.02 | 424 |
| 50 | 1.16 | 117 | 1.42 | 112 | 2.2 | 117 | 5.54 | 109 | 8.75 | | 13.6 | 369 |
| 60 | 1.25 | 114 | 1.57 | 102 | 2.4 | 111 | 6.09 | 107 | 9.8 | | 14.6 | 370 |
| 70 | 4.5 | 108 | 1.7 | 93 | 2.6 | 98 | 6.44 | 105 | 10.56 | | 16.1 | |

SPRAY NOZZLE

The present invention relates to a nozzle construction, and particularly to a nozzle construction having significant utility in connection with directing cleaning fluids into the intakes of gas turbines to provide a thorough cleaning of the compressor and other elements thereof.

BACKGROUND OF THE INVENTION

U.S. Pat. No. 5,011,540 to the present inventor teaches the use of a series of nozzles arranged and positioned to generate a mist or fine droplet fog of a washing fluid around, for example, the periphery of the air intake of a gas turbine engine. The washing fluid is supplied to the nozzles under pressure, the nozzles converting the fluid flow into a fog, which is drawn through the turbine as it operates and contacts the vanes and blades of the turbine's compressor to attack and remove contaminants from the compressor surfaces. The nozzles are positioned to inject the fog into areas of relatively low-speed turbulent air, the fog being drawn into the turbine in a manner that creates a uniform dispersion of the fog and effective cleaning of the compressor surfaces. Different wash fluids may be injected, depending on the nature of the cleaning to be accomplished, and different fluids may be used during different phases of the cleaning process.

Depending on the specific application, a wide range of fluid pressures and droplet sizes that may be employed. In "on-line" washing, the turbine is fired and can be running at any load or speed conditions, so the compressor wash solutions must be injected with droplets sufficiently small that they do not cause any erosive or mechanical damage when they impinge at high velocity onto the stationary and rotating compressor airfoils. At the same time, however, the droplets must be sufficient size, mass and quantity to break through the airfoil surface boundary layer and provide comprehensive wetting to the surface deposits. In practice such droplets are typically in the size range of about 100-200μ, the recognized industry standard for chemical cleaning processes of this type.

"Off-line" or "off-crank" cleaning is performed by injecting cleaning solution into the compressor via a nozzle system while the turbine rotor is being turned at about 10 to 25 percent of its normal operating speed in order to disperse the cleaning fluid effectively throughout the compressor section. The rotor is physically turned by an electric motor or diesel powered starting device or, in the case of large gas turbine generators, by inducting the generator itself to turn the rotor. Since off-line cleaning has to date been designed as a short duration, high volume deluge wash procedure, their injection nozzle systems have tended to be cruder, with larger droplet sizes and higher flow rates. In some cases high pressure injection, up to about 2,000 PSIG have been employed, but in either case such nozzle systems are not suited to on-line washing because of the dangers of thermal shock, mechanical damage, and compressor blade erosion.

The common arrangement for compressor cleaning systems is therefore to have a separate arrangement of nozzles, and sometimes a separate wash skid, for on-line cleaning and off-line cleaning—thus increasing the cost of hardware and installation.

The present invention provides a spray nozzle that offers the opportunity, when operating in conjunction with a variable pressure fluid delivery system or wash skid, of being ideal for both on-line and off-line compressor washing.

For example, in on-line cleaning there is no advantage in injecting a specific volume of cleaning solution over a short period of just a few minutes, since a large percentage of the solution would be immediately wasted to the combustion system and, more importantly, the actual chemical contact time with the compressor deposits would be insufficient to ensure a good cleaning result. Instead the ideal is to inject the same or even a smaller volume of cleaning solution over a longer period—say 10 to 15 minutes or even more—by lowering system operating pressure to about 100 to 150 PSIG to reduce the nozzle flow rates. This simple procedure substantially reduces the wastage of cleaning fluid and substantially increases the all-important chemical contact time with the surface deposits on the compressor airfoils to produce a better cleaning result.

Likewise in the case of off-line cleaning the injection of the cleaning solution into the compressor does not actually require the cleaning fluid to be injected in a deluge process over a short period of time, as this procedure also results in the wastage of much of the costly cleaning chemical directly to the drains without it having done any useful work. Like on-line cleaning, good results from off-line cleaning also very much depend on allowing the chemical cleaning solution to remain in contact with the surface deposits for as long as possible during the actual injection of the cleaning solution (about 10 to 15 minutes or more) and during a soak period, typically 30 to 60 minutes, when the rotor is at rest.

Thus, a realistic fluid injection pressure of 100 to 150 PSIG is all that is required to deliver the cleaning solution to the compressor for off-line washing. However, a vital element of the off-line washing procedure is to ensure thorough post-wash rinse-out of the entire compressor, combustor and turbine section of the gas turbine with plain water is achieved; if loosened deposits containing corrosive elements, such as salt, etc. are left in the machine when it is fired up they can subsequently cause accelerated compressor and, more particularly, hot section corrosion.

To ensure effective post-wash rinsing it is therefore essential to ensure an adequate flow and velocity of rinsing water. The nozzle design of the present invention allows this to be easily achieved by simply increasing the nozzle injection pressure. The nozzle design enables the nozzle flow rate to be increased approximately four-fold between 100 and 900 PSIG for highly effective post-wash rinsing.

Conventional nozzle systems are typically ill equipped to operate satisfactorily across the range of pressures and flows needed to meet safety and practical requirements of both on- and off-line compressor cleaning. While nozzles are known that deliver a spray through a nozzle aperture located on the end wall of the nozzle as well as from a nozzle aperture located on the nozzle sidewall, neither configuration has heretofore been able to function over a range of operating pressures and droplet sizes with a consistent design, thus preventing real economies in manufacture and use to be realized.

Further, since the orientation of the spray nozzles is dependent upon the nature and configuration of the turbine and the compressor with which they are to be employed, as well as the intended primary target for the wash spray, it is of significant benefit to have a nozzle construction that may be easily adapted for a variety of turbine configurations. Nozzle constructions in which the outlet orifice is in a nozzle end wall are difficult to mount and orient properly and often require a large plurality of individual nozzles to provide the desired spray pattern, and current side spray nozzles of consistent design have also been unable to provide the needed variability in overall spray configurations.

Benefits of the nozzle construction of the present invention include the ability to accommodate a wide range of fluid pressure and droplet sizes, as well as the ability to incorporate a plurality of nozzle outlets in a unitary body. The present invention has a side-spray configuration, allowing great adaptability to a wide variety of use environments, and the individual nozzle outlets can each be of a different geometry to provide differing spay patterns, and can be differently oriented along and about the nozzle body to create the appropriate spay pattern for the turbine and compressor configuration with which the nozzle is to be employed.

In addition to use in spray cleaning operations, the nozzle of the present invention may have utility in other turbine-related applications, such as for the injection of fluid to increase mass flow, as well as in other non-turbine applications, wherever a fine droplet spray or fog is needed.

BRIEF DESCRIPTION OF THE INVENTION

In accordance with the foregoing, a spray nozzle designed and constructed in accordance with the present invention comprises an elongated nozzle body with a fluid delivery bore located therein. The delivery bore is in the form of a right angle channel, having a longitudinally-extending main channel with an entranceway at one end of the nozzle and a transverse bore or channel terminating at a spray exit bore or aperture extending through a lateral side of the nozzle. A swirler head is mounted in the transverse bore. The swirler head creates a swirling turbulent flow for the fluid passing through and about the head, and in conjunction with the spray bore allows the flow existing through the spray bore to be in the form of a fine mist of appropriately sized fluid particles. The swirler head includes a reduced diameter neck portion about which the fluid is introduced, allowing the fluid full circumferential contact with and passage through and about the swirler.

The simplified construction of the nozzle, consisting essentially of an elongated body and mounted swirler, allows the nozzle to be manufactured and assembled efficiently, and permits appropriate adjustment of the associated parameters in accordance with specific use requirements.

BRIEF DESCRIPTION OF THE DRAWINGS

A fuller understanding of the present invention will be acquired upon consideration of the following detailed description of preferred but nonetheless illustrative embodiments of the invention, when considered in association with the annexed drawings, wherein:

FIG. 8 is a chart illustrating flow rate and droplet size a various fluid pressures for a series of nozzles constructed in accordance with the invention.

DETAILED DESCRIPTION OF THE INVENTION

Figure 1A:
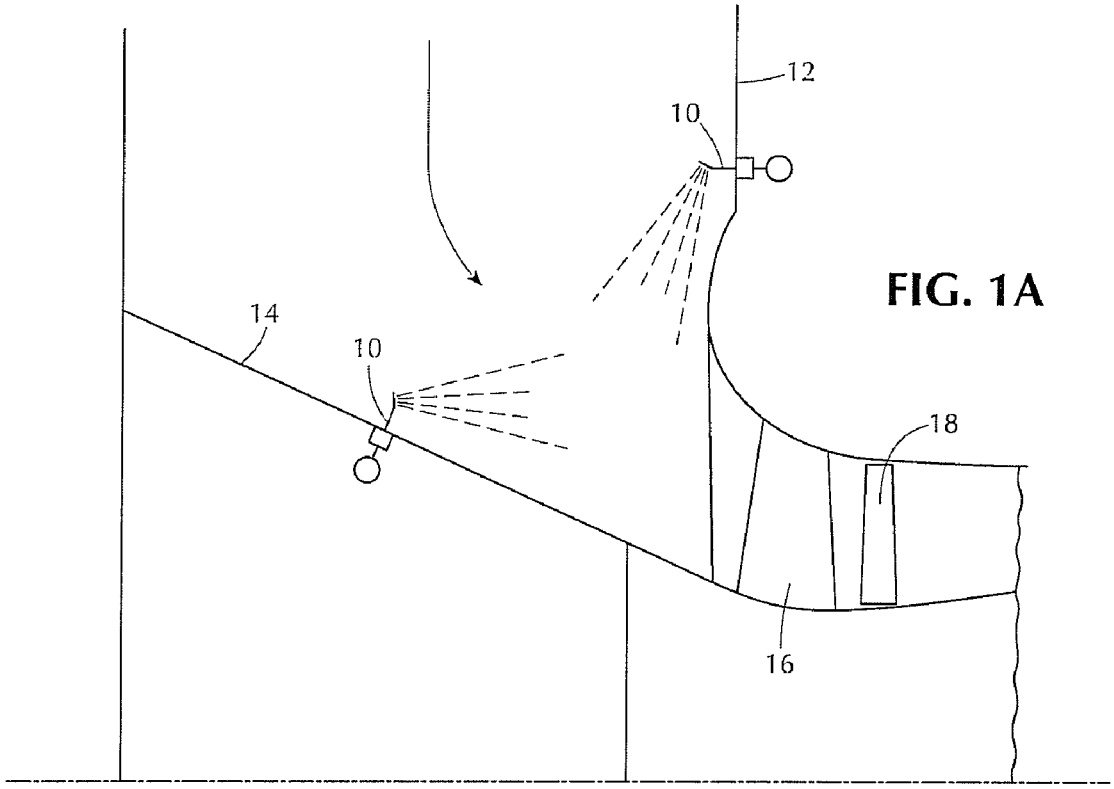
FIGS. 1A, 1B and 1C are diagrammatic representations of representative orientations for nozzles of the present invention in conjunction with gas turbine systems.
Figure 1B:
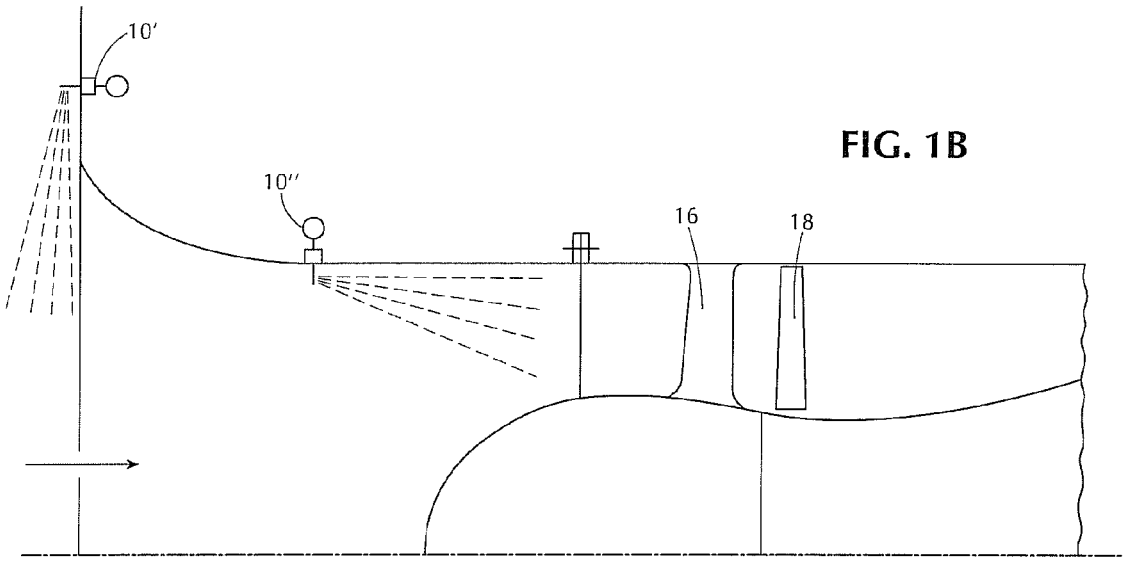
Figure 1C:
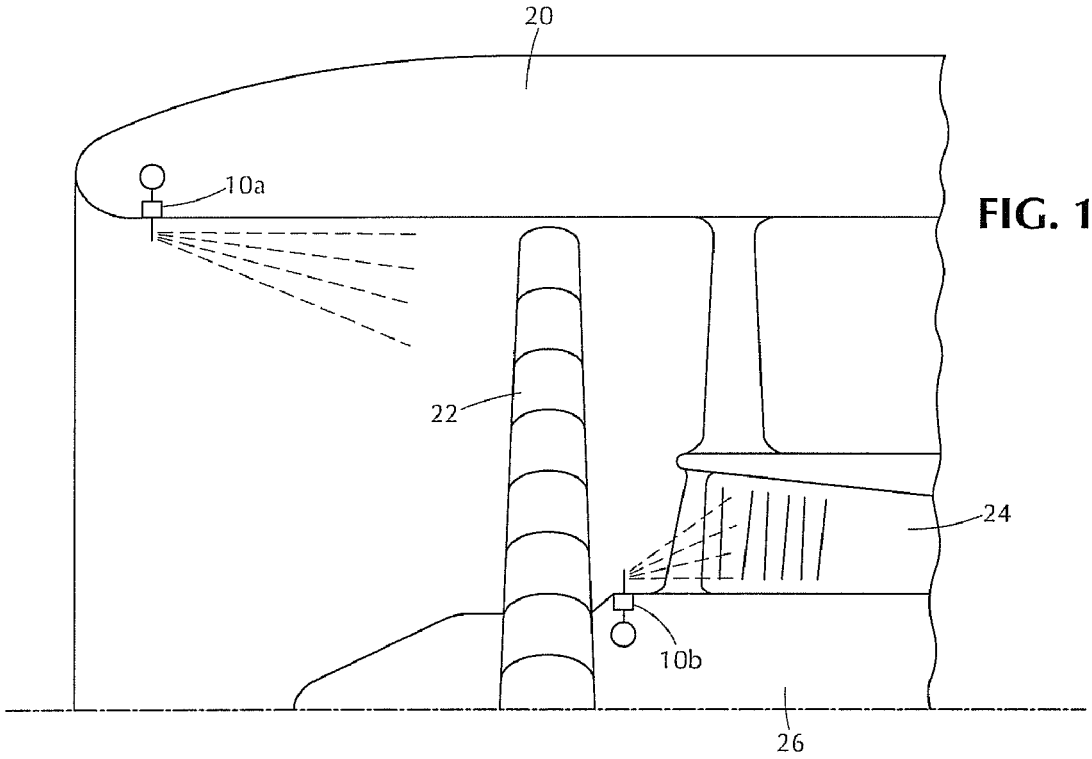

FIGS. 1A through 1C depict illustrative orientations of spray nozzles of the present invention, presented as diagrammatic half-section views of the inlet side of representative turbine configurations with which the invention may be employed. It is to be appreciated that a plurality of nozzles may be arranged in similar fashion about the periphery of the housings to achieve the desired full spray coverage.

FIG. 1A depicts a pair of nozzle assemblies 10, one of which is mounted on plenum wall 12 and one mounted on cone wall 14 of a radial inward compressor for an industrial gas turbine. As known in the art, the nozzles are positioned to generate spray fogs in areas of low-speed, relatively turbulent air to facilitate a uniform intake of the spray into the compressor, passing through and cleaning, for example, bell-mouth struts 16 and inlet guide vanes 18, as well as the compressor blades (not shown).

FIG. 1B depicts the alternative positioning of nozzle assemblies 10 in an industrial type axial flow inlet gas turbine of an aero derivative construction. Nozzle 10' is shown in a typical position for on-line cleaning operation, while nozzle 10" is in a position appropriate for off-line cleaning operation. Once again, the positioning of the nozzle in a region of relatively low velocity high turbulence flow facilitates full distribution of the spray.

FIG. 1C likewise presents the positioning of the nozzles 10 in conjunction with a turbofan jet engine for aeronautical use. Nozzle 10A is mounted to engine casing 20. Its spray is directed for cleaning of main fan 22 and thereafter core engine compressor 24. Second spray nozzle assembly 10B is mounted to the engine core 26 and further provides a dedicated spray for the core engine compressor 24.

As the foregoing illustrates, nozzle systems of the present invention may be employed in a variety of situations. The specific uses and positioning of the nozzles as depicted are not intended to be in any way limiting.

Figure 2:
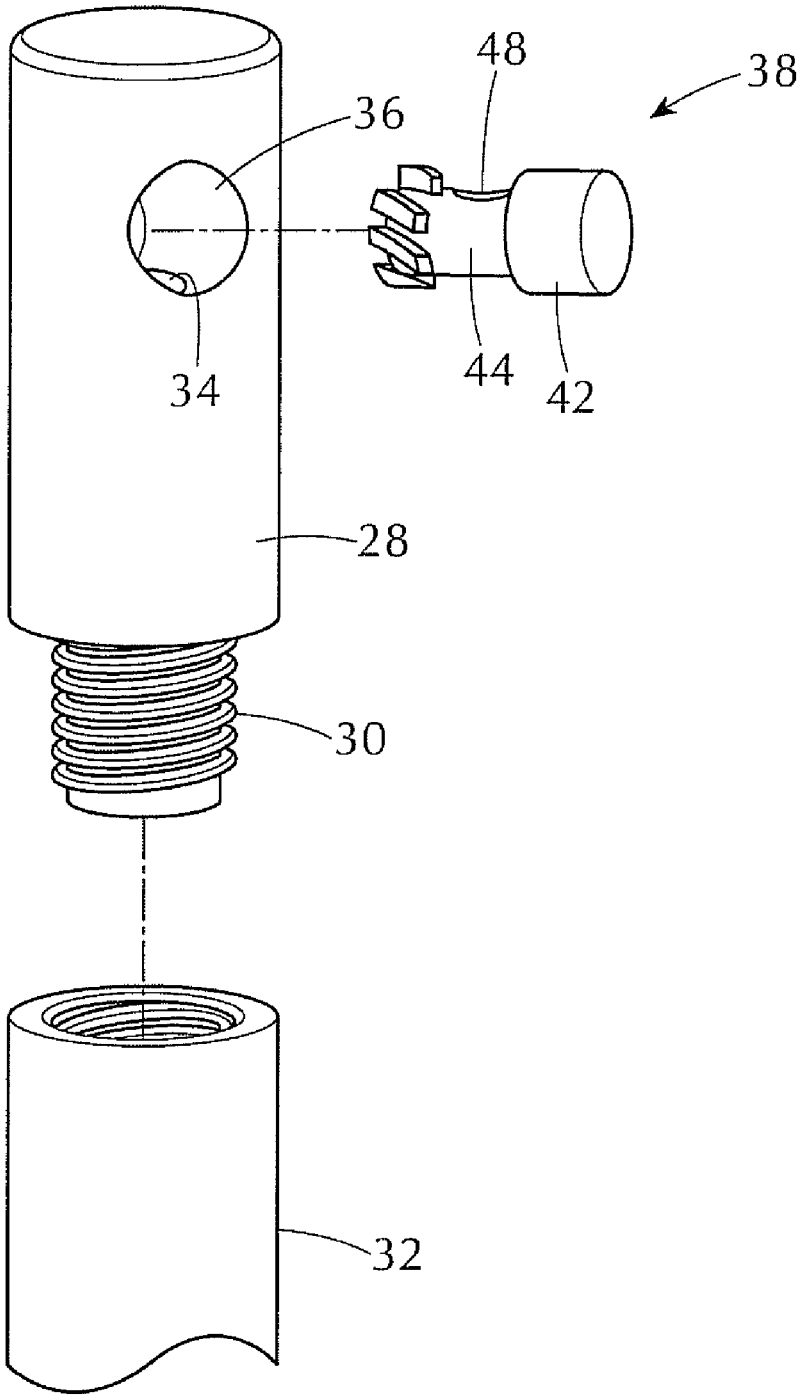
FIG. 2 is an exploded perspective view of an embodiment of the invention.
Figure 3:
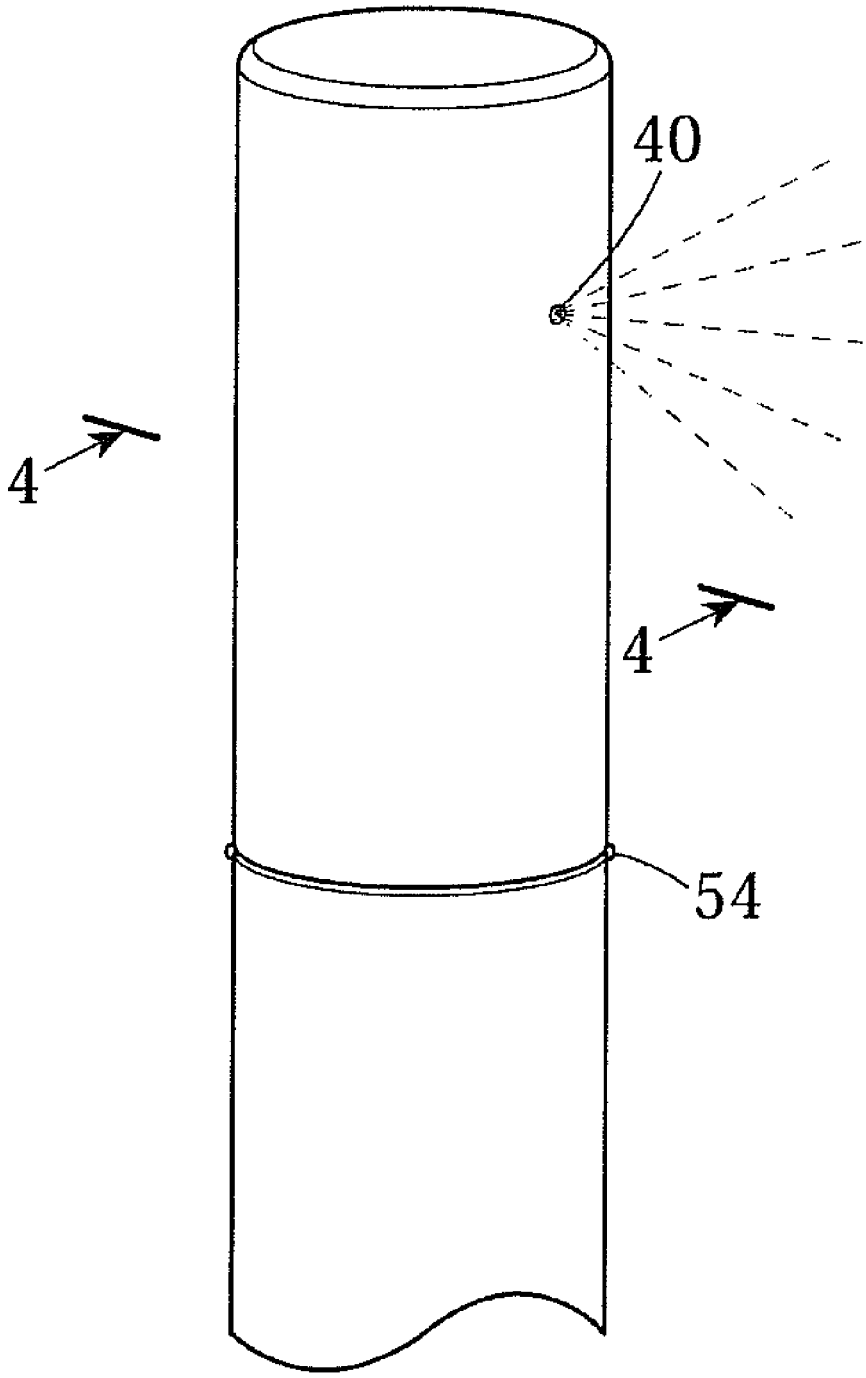
FIG. 3 is a perspective view of the embodiment of FIG. 2 in which the spray aperture is visible.
Figure 4:
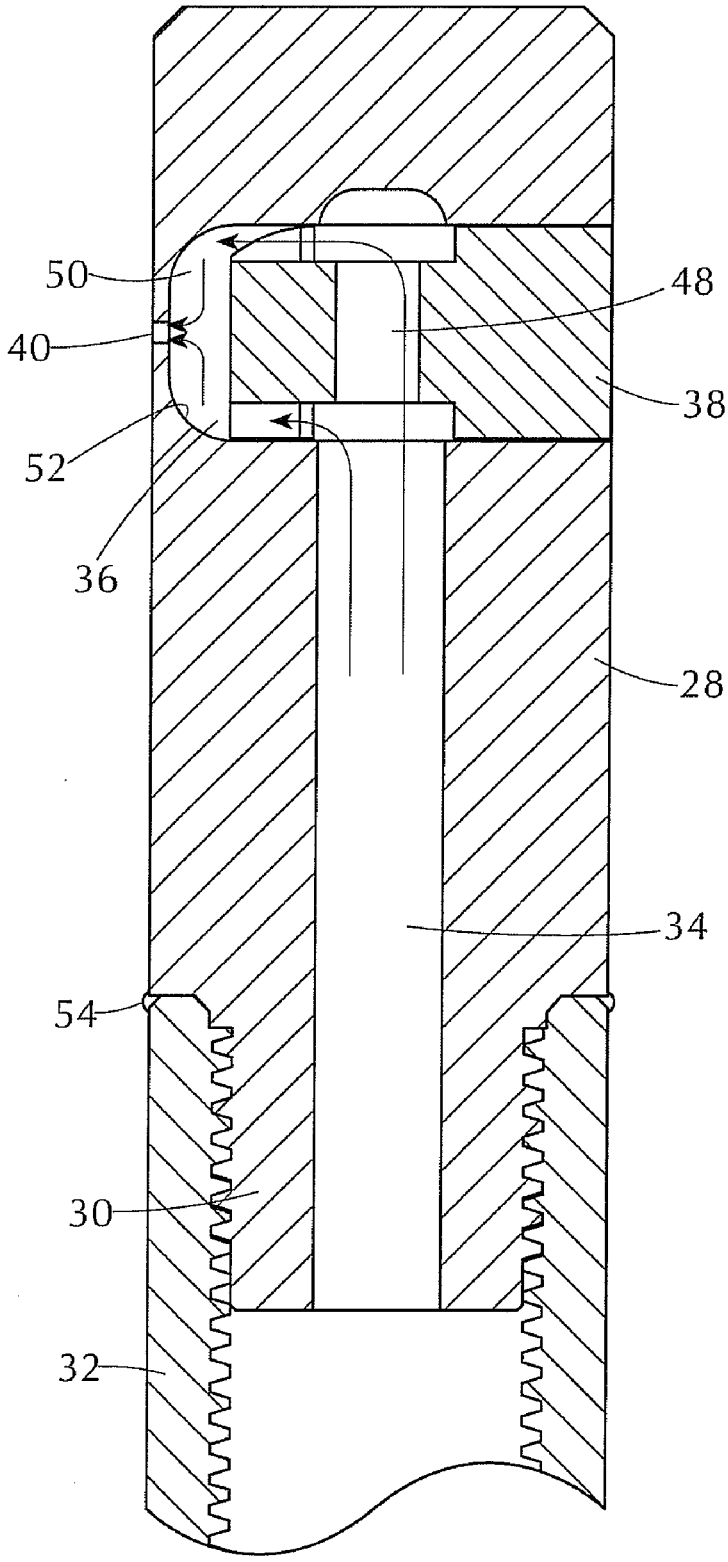
FIG. 4 is a sectional view taken along line 4-4 of FIG. 3.

Referring next to FIGS. 2 through 4, a first embodiment of nozzle 10 includes nozzle body 28, formed of a solid rod of an appropriate material, typically stainless steel. The nozzle body 28 may be provided with an integral threaded mounting portion 30, allowing the body to be threadedly-engaged with an appropriate fluid delivery pipe 32. Typically, the delivery pipe 32 may incorporate fittings, flanges, collars and/or the like to allow an integrated nozzle system, including nozzle 10, to be mounted to as appropriate, such as on a plenum wall, engine casing, or the like, as exemplified in FIGS. 1A-C. As further suggested by FIGS. 1A through 1C, fluid delivery pipe 32 may also be of an angled construction to facilitate proper orientation of the nozzle and its emitted spray.

Nozzle body 28 is provided with a central longitudinal bore 34 which extends from the threaded connector end of the body. The bore terminates adjacent the distal end of the body, and intersects at its distal end with a transverse bore 36 through the sidewall of the nozzle body in which swirler head 38 is mounted. Advantageously, both longitudinal bore 34 and transverse bore 36 are cylindrical, allowing them to be efficiently and economically machined. The transverse bore 36 is provided with a relatively small diameter spray outlet bore 40, as known in the art, at its bottom face which provides an outlet for the washing fluid introduced into central bore 34 by fluid delivery pipe 32 and which subsequently passes through transverse bore 36 and the mounted swirler.

Figure 5:
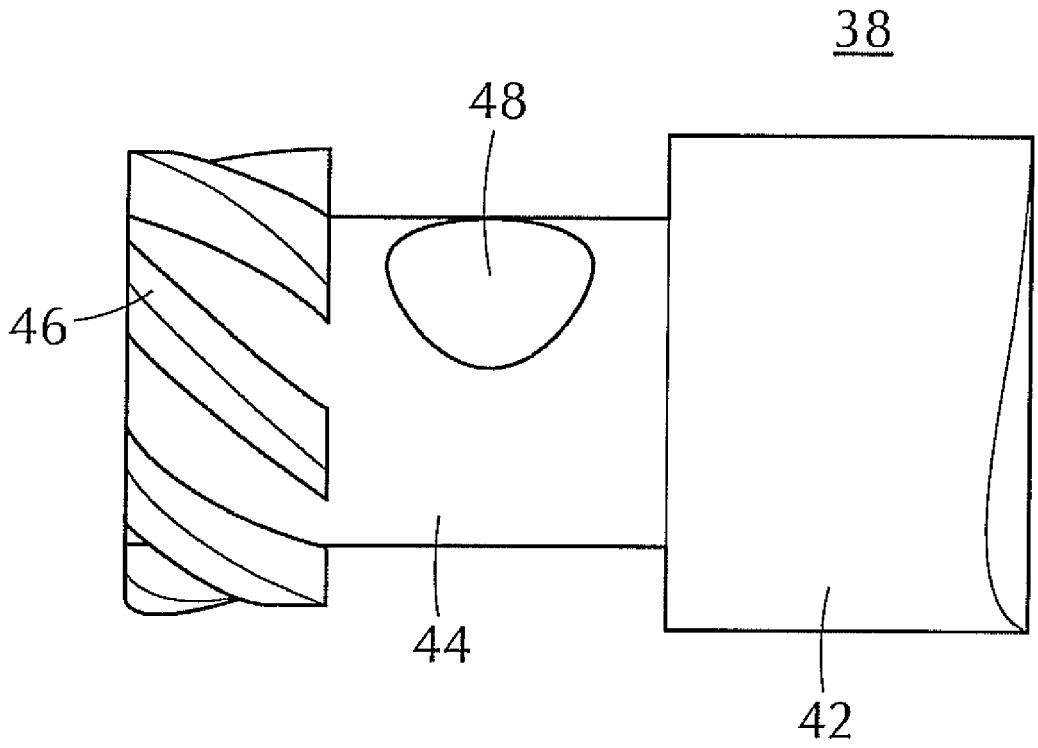
FIG. 5 is an enlarged view of a swirler of the inventive construction.

Swirler body 38 provides the means by which the cleaning fluid is transferred from the central bore 34 through the transverse bore 36 and spray outlet 40. As detailed in FIG. 5, it comprises a base 42 dimensioned to fit with a high degree of precision within transverse bore 36 and to support the swirler in position therein. Base 42 supports a neck 44 of reduced diameter which at its distal end supports a head having a plurality of angled vanes 46, forming a plurality of angled fluid flow channels therebetween. A transverse bore 48 extends through the neck. As may be seen in FIG. 4, the swirler 38 is so oriented in the nozzle body and transverse bore 36 such that the central annular portion of neck 44 is aligned with main bore 34, with transverse neck bore 48 facilitating the flow of washing fluid from main bore 34 around the full periphery of the neck. The flow channels between angled vanes 46 impart an angular velocity and turbulence to the fluid, which then passes into the end chamber portion 50 of transverse bore 36. The swirling, turbulent flow of fluid is atomized and is ejected through the spray outlet 40 as a fog of small size droplets.

The two-piece construction of the nozzle head as depicted in FIG. 4 allows for both economical and high precision construction and installation to be performed. With the swirler 38 inserted in the transverse bore, it may be TIG-welded into place, forming a rigid integral unit. Alternatively, the base 42 of the swirler and the corresponding portion of bore 36 may be complementarily threaded to allow the swirler to be mounted in the bore. In a similar manner, nozzle body 28 may be TIG-welded at 54 to the threaded connector portion 30, the welds being subsequently machined as known in the art to yield a construction that has the appearance of a single unitary element capable of withstanding the rigors of the environment in which it is placed.

Advantageously, transverse bore 36 may be bored or machined with an arcuate transition portion 52 between its cylindrical sidewall and planar bottom face. The commencement of the arcuate section on the bore sidewall can provide a stop for the swirler 38, allowing it to be inserted against the stop with the main axis of its transverse bore 48 aligned with that of central bore 34.

Figure 6:
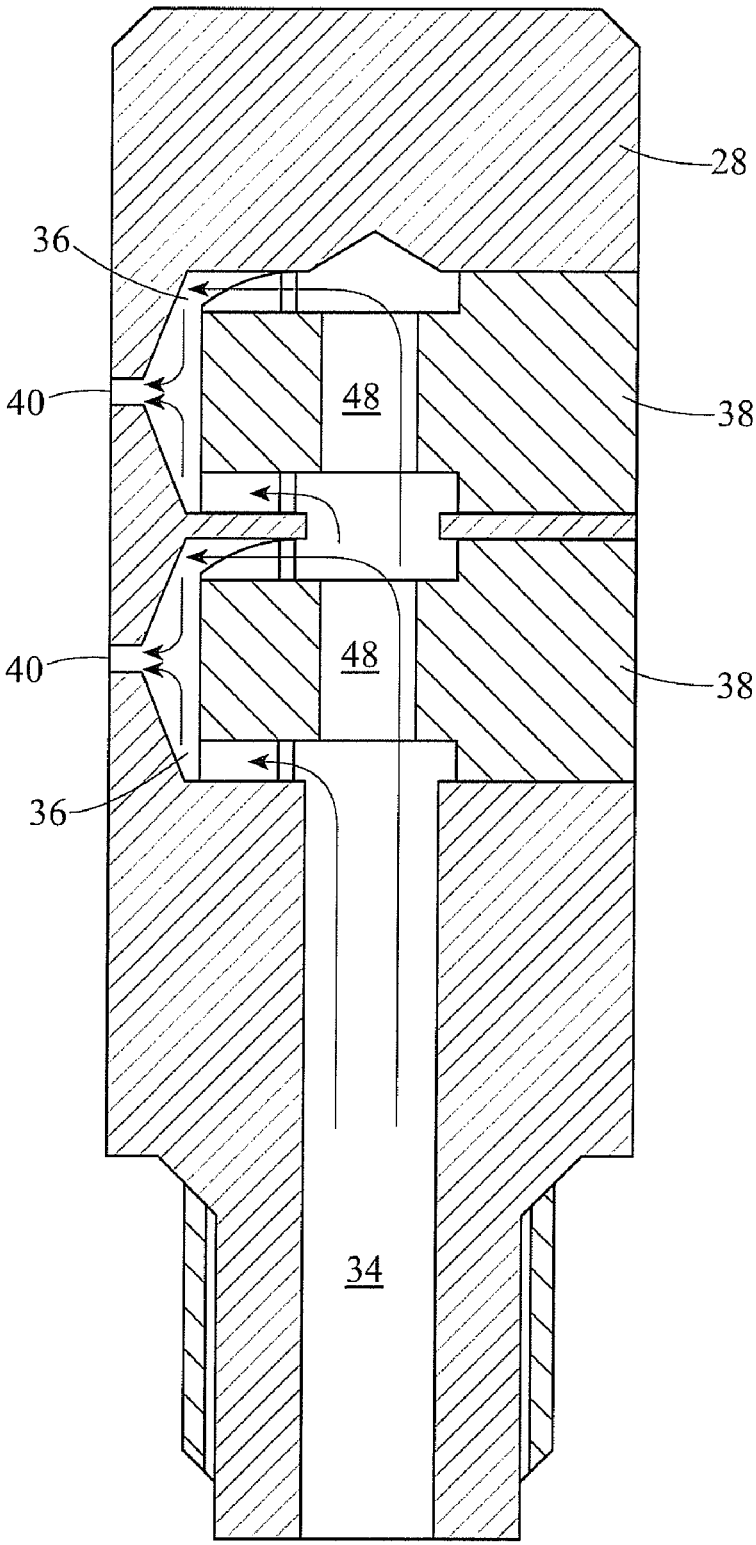
FIG. 6 is a sectional view, similarly oriented to that of FIG. 4, presenting an alternative embodiment of the invention.

FIG. 6 depicts an alternative embodiment of the invention in which two spray outlets 40 are provided, allowing the resulting fluid spray pattern to encompass a greater area. In a manner analogous to the construction of the first embodiment, the nozzle body 28 incorporates a central bore 34 that intersects with a pair of spaced transverse bores 36. While the bores 36 may be aligned parallel to each other, as depicted in the Figure, it is to be appreciated that they can be radially offset with respect to each other, whereby the respective spray outlets 40 direct the exiting spray in differing radial directions. Each of the transverse bores 36 carries a respective swirler 38, the transverse bores 48 of which are aligned with central bore 34, providing a continuous pathway for the fluid to and around both swirlers for delivery by the respective spray outlets 40. It is to be appreciated that additional transverse bores, swirlers and spray outlets can likewise be provided.

Figure 7:
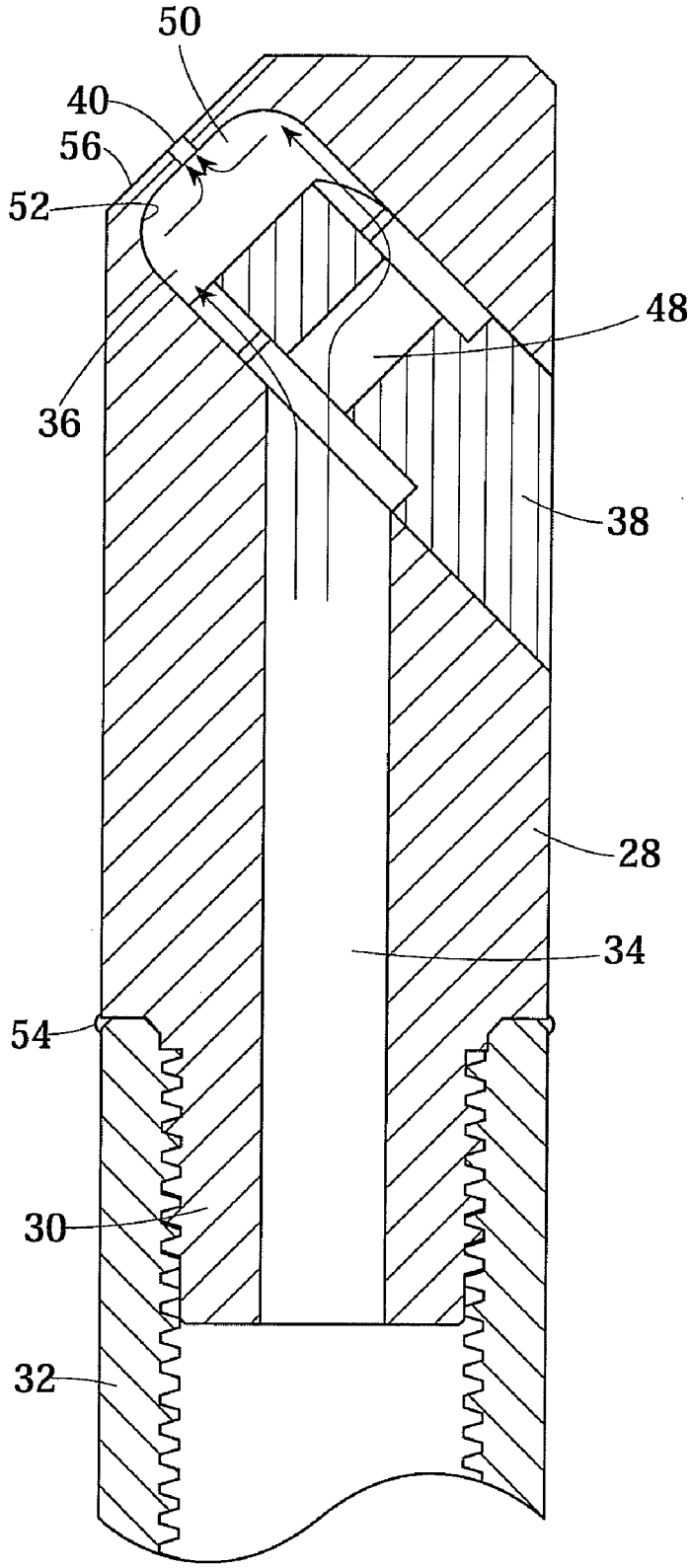
FIG. 7 is a sectional view, similarly oriented to that of FIG. 4, presenting a further embodiment of the invention.

In addition to constructions in which a transverse bore 36 for a swirler extends in a radial direction, perpendicular to the main axis of the nozzle body and main bore 34, it is also possible to machine a transverse bore 36 at an angle other than perpendicular to the axis of bore 34, providing further control over the ultimate direction and configuration of the produced spray in accordance with requirements of the installation, as depicted in FIG. 7. While the angle between the main axes of the central bore 34 and the transverse bore 36 can be at any angle greater than 0 and less than 180 degrees with respect to the main axis of the central bore 34, the figure shows the transverse bore 36 at an angle of about 45 degrees. The portion of the body sidewall through which the spray outlet bore 40 extends may be chamfered at 56 to be perpendicular to the axis of the outlet bore. The distal end of the swirler's base is likewise machined on a bias to be flush with the nozzle body.

In a typical application, the swirler 38 may be preferably provided with four or seven vanes and channels at a 45 degree angle to the main longitudinal axis of the head. Typical dimensions for the channels in a seven vane configuration are approximately 1.45 mm width×0.9 mm depth. The diameter of the swirler, and thus the transverse bore in which it is mounted, may be on the order of 6.35 mm with the neck being 4.5 mm in length and supporting a transverse bore of 2.7 mm diameter.

A nozzle body 28 may be, for example, on the order of 40 mm long with a main diameter of 13.8 mm. Spray outlet bore 40 may be on the order of 0.6 mm diameter, but it is to be appreciated that the specific size thereof may be adjusted as appropriate for the spray pattern desired. Typically outlet bore diameters range from 0.50 to 3.50 mm, with four slot swirlers being preferable at smaller diameter outlet bores. Seven slot swirlers have been found to be more appropriate with outlet bore of about 1.5 mm and above. For a given slot configuration outlet droplet size decreases and flow rate increases as fluid pressure is increased. The fewer the number of slots the lesser the fluid flow rate. With a typical swirled diameter of 6.35 mm seven slots represent a practical maximum for efficient machining.

FIG. 8 depicts flow rates and observed droplet sizes for a single bore nozzle of the present invention with spray bore diameters of from 0.50 to 3.50 mm. Consistent with observed results, 4 slot swirlers are employed with smaller spray bore diameter systems. The chart illustrates the wide range of droplet sizes and flow rates that can be accommodated with the same basic construction. Pressures are expressed in BARG (bar gauge); 1 bar=100 kPa (kilopascals).

The side spray nozzle of the invention allows a multiplicity of sprays to be accommodated in a single spray body of relatively small diameter, allowing a reduction in the physical number of nozzles needed to achieve the desired comprehensive wetting effect. Reduction of the number of nozzles equates to a lower capital cost and cost of installation.

Increased overall flow rates can be accomplished at a desired droplet size by increasing the number of nozzle outlets, rather than by enlarging the orifice size as would be required in a single outlet spray nozzle, resulting in an increased droplet size. The flow range of a nozzle of the invention can be varied within a reasonable range without substantial droplet size change simply by changing the pressure, allowing the same nozzle system to be used for both on- and off-line cleaning.

Those skilled in the art will appreciate that modifications and adaptations of the foregoing may be accomplished without departing from the spirit and scope of the invention, which is to be determined with consideration of the foregoing and the annexed claims.

I claim:

1. A fluid delivery nozzle, comprising an elongated nozzle body having a fluid delivery bore with a first passageway section extending longitudinally therein and having a fluid entranceway for receipt of a fluid to be sprayed, and a connected transverse nozzle bore section through a sidewall of the nozzle body terminating in a reduced diameter spray bore through the sidewall, and a swirler mounted in the nozzle bore section, the swirler having a head section with a plurality of passageways formed between swirl vanes arranged about a periphery of the head section to pass the fluid to the spray bore and an adjacent neck section of a reduced diameter forming an annulus between the neck section and the nozzle body in fluid-passing contact with the first passageway section and head section to direct the fluid from the first passageway section through the nozzle bore section for exit through the spray bore, the neck section of the swirler further having a bore extending transversely therethrough in fluid-passing contact with the first passageway section.

2. The nozzle of claim 1 wherein a main axis of the swirler neck section transverse bore is aligned with a main axis of the first passageway section.

3. The nozzle of claim 1, wherein the nozzle bore section of the fluid delivery bore has a tapered wall portion leading to the spray bore, a leading edge of the head section of the swirler engaging a trailing edge of the tapered wall portion to define a fluid-receiving chamber of the nozzle bore directly adjacent the spray bore.

4. The nozzle of claim 1, wherein the first passageway section has a distal portion extending beyond the nozzle bore section.

5. The nozzle of claim 1, wherein the swirler is permanently mounted within the nozzle bore.

6. The nozzle of claim 1, wherein the fluid delivery bore further includes a second nozzle bore section and a swirler mounted therein in accordance with claim 1.

7. The nozzle of claim 1, wherein the nozzle bore is at an angle of 90 degrees to the first passageway section.

8. The nozzle of claim 1, wherein the fluid entranceway is located at an end of the nozzle body.

9. A fluid delivery nozzle, comprising a nozzle body having a fluid delivery bore for the fluid to be delivered with a first linear passageway section extending longitudinally therein and forming a fluid entranceway and a connected linear nozzle bore section intersecting at an angle with the first passageway section and terminating in a reduced diameter spray bore at a side of the nozzle body, and a swirler mounted in the nozzle bore section, the swirler having a head with a plurality of passageways formed between swirl vanes arranged about a periphery of the head to pass the fluid to the spray bore and an adjacent neck section of a reduced diameter forming an annulus between the neck section and the nozzle body in fluid-passing contact with the first passageway section and nozzle head to direct the fluid from the first passageway through the nozzle passageway for exit through the spray bore, the neck section having a transverse through-bore in fluid passing contact with the first passageway section.

10. The nozzle of claim 9, wherein the swirler in mounted in the nozzle bore section with a rear surface of the swirler aligned with an outer surface of the nozzle body, the swirler being TIG welded to the nozzle body, the weld being finished to present a smooth surface finish across the swirler and nozzle body.

11. The nozzle of claim 9, wherein the swirler is positioned in the nozzle bore section to align a main axis of the nozzle neck section with a main longitudinal axis of the first passageway section.

* * * * *